United States Patent [19]

Fujii et al.

[11] Patent Number: 4,516,099

[45] Date of Patent: May 7, 1985

[54] ELECTROMAGNETIC RELAY

[75] Inventors: Kunihisa Fujii, Saku; Noboru Tomono, Usuda; Hajime Watanabe, Saku; Yasushi Miyakoshi, Komoro, all of Japan

[73] Assignee: Takamisawa Electric Co., Ltd., Tokyo, Japan

[21] Appl. No.: 368,584

[22] Filed: Apr. 15, 1982

[30] Foreign Application Priority Data

Apr. 17, 1981 [JP] Japan ..... 56-54587[U]

[51] Int. Cl.[3] ..... H01H 51/08

[52] U.S. Cl. ..... 335/135; 200/283; 335/196

[58] Field of Search ..... 335/135, 128, 202, 196; 200/283

[56] References Cited

U.S. PATENT DOCUMENTS

| | | | |
|---|---|---|---|
| 3,626,339 | 12/1971 | Lisnay | 335/202 |
| 3,842,231 | 10/1974 | Schedele et al. | 200/283 |
| 4,310,818 | 1/1982 | Essler et al. | 200/283 |

FOREIGN PATENT DOCUMENTS

| | | |
|---|---|---|
| 16-9092 | 4/1941 | Japan . |
| 54-56762 | 4/1979 | Japan . |

*Primary Examiner*—Harold Broome

*Attorney, Agent, or Firm*—Armstrong, Nikaido, Marmelstein & Kubovcik

[57] ABSTRACT

In an electromagnetic relay, one of the spring members of the electromagnetic relay is fixed to a cubic corner protrusion of a base block of a housing. Side projections provided in the spring member are fitted into deep holes which adjoin a slot in the cubic corner protrusion so that the spring member becomes firmly fixed to the base block.

6 Claims, 9 Drawing Figures

ELECTROMAGNETIC RELAY

TECHNICAL FIELD

The present invention relates to an electromagnetic relay, particularly to the structure for the fixing of a spring member of the electromagnetic relay to the base block of the housing of the electromagnetic relay.

BACKGROUND OF THE INVENTION

The electromagnetic relay of the present invention is of a small size, for example 32×35×32 mm, wherein an assembly of elements of the electromagnetic relay, such as an electromagnet, an armature, a card, a movable contact carried on a movable contact spring, a fixed contact carried on a fixed contact spring, and a restoring spring, is encased in a housing formed by a plastic base block and a plastic cover.

A prior art structure for fixing one of the springs of the electromagnetic relay, for example, the restoring spring, to the base block is illustrated in FIG. 1. The electromagnetic relay of FIG. 1 comprises a plastic base block 1', a restoring spring 2', a movable contact spring 3', a fixed contact spring 4', a card 5', an armature 6' and an electromagnet 7'. The electromagnet 7' comprises a core 73', a bobbin 72', a coil 71' and a yoke 74'.

The two terminal conductors (not shown) of the coil 71', the terminal conductor 32' of the movable contact spring 3', and the terminal conductor 42' of the fixed contact spring 4' penetrate through the corresponding apertures of the base block 1' so that the structure of the electromagnet is coupled to the base block 1'. Also, in order to ensure the fixing of the restoring spring 2' to the base block 1', one end of the restoring spring 2' is pressed into a slot 111' in the cubic corner protrusion 11' of the base block 1'.

However, in the prior art structure of FIG. 1, there is a problem in that the restoring spring 2' is not sufficiently firmly fixed to the cubic corner protrusion 11', because such a mere pressing of the restoring spring 2' into the slot 111' cannot achieve a firm holding of the restoring spring 2' by the cubic corner protrusion 11'. This is because, when the restoring spring 2' is subjected to frequent spring action or is subjected to vibrations, the restoring spring inevitably becomes loosened from the cubic corner protrusion 111'.

In the structure of FIG. 1, the thickness of the restoring spring 2' cannot be thicker than a predetermined thickness, due to the design requirements of the electromagnetic relay, while the gap length of the slot 111' cannot be smaller than a predetermined length due to the plastic moulding process requirements. Under these circumstances, in the prior art structure, a restoring spring is constructed in which the thickness of the end portion corresponding to the slot of the cubic corner protrusion is larger than the thickness of the rest of the restoring spring or in which a depression is formed by a shock-pressing process near the end portion of the restoring spring corresponding to the slot of the cubic corner protrusion causing the effective thickness of the end portion to be increased, so as to make the thickness of the end portion of the restoring spring match the width of the gap of the slot in the cubic corner protrusion.

However, there is also another problem in that the manufacture of such a restoring spring, consisting of portions having different thicknesses, increases the cost of the production of the device and in that the fixing of the restoring spring, having such a depression in the end portion, to the slot of the cubic corner protrusion does not provide a completely firm fixing there between.

SUMMARY OF THE INVENTION

The object of the present invention is to provide an improved structure of the electromagnetic relay of the type described above, wherein the above described problem is solved and a satisfactorily firm fixing between an element of the electromagnetic relay and the base block of the housing is achieved, so that a satisfactory structure and a reliable operation of an electromagnetic relay are ensured.

According to the present invention, there is provided an electromagnetic relay comprising a base block, an electromagnet, an armature, a card and a plurality of spring means, wherein a cubic protrusion is formed on a predetermined portion of said base block, a slot having deep holes adjoining said slot is formed in said cubic protrusion, a plurality of side projections are formed in a portion of at least one of said spring means, and said portion of said spring means having said plurality of side projections is inserted into said slot of said cubic protrusion, in such a manner that said plurality of side projections are inserted into said deep holes of said slot.

DESCRIPTION OF THE PREFERRED EMBODIMENTS

Figure 1:
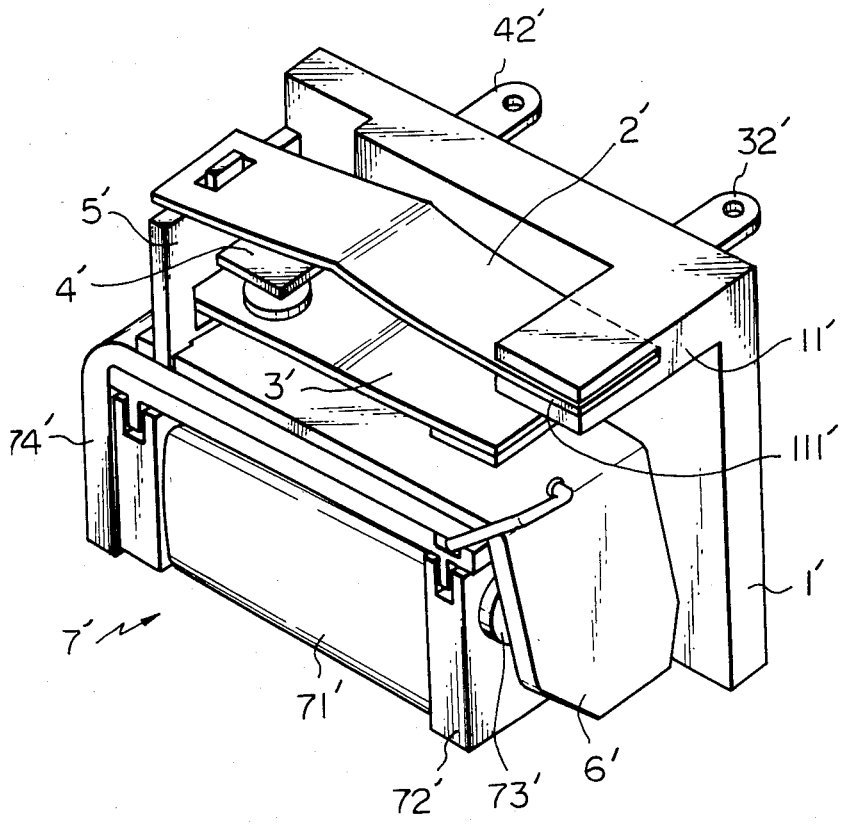
Fig. 1 Prior Art
FIG. 1 illustrates a structure of a prior art electromagnetic relay.
Figure 2:
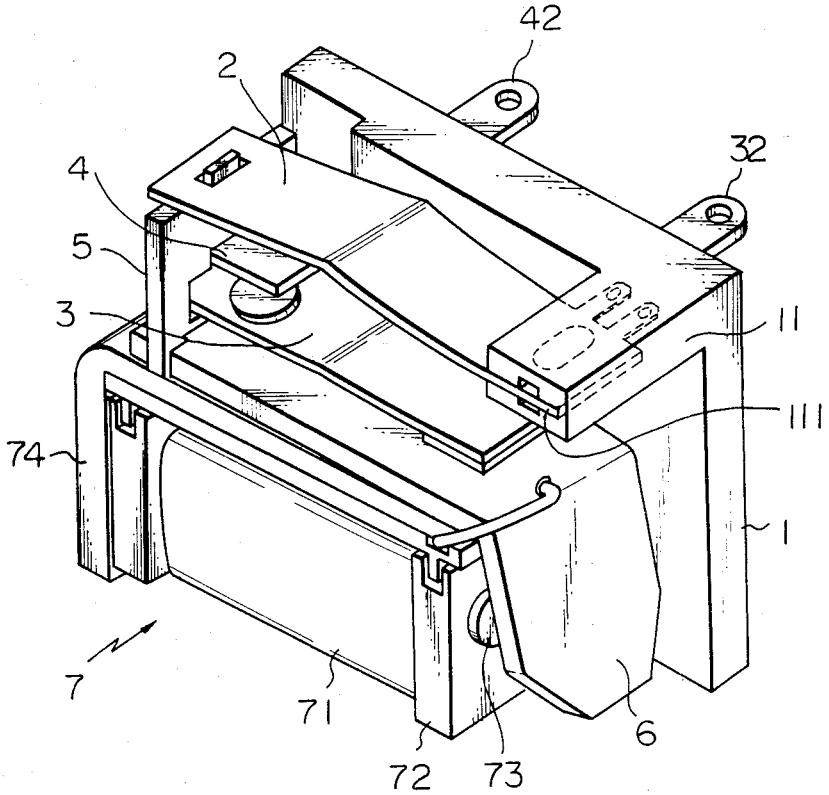
FIG. 2 illustrates a perspective view of the structure of an electromagnetic relay according to an embodiment of the present invention.
Figure 3:
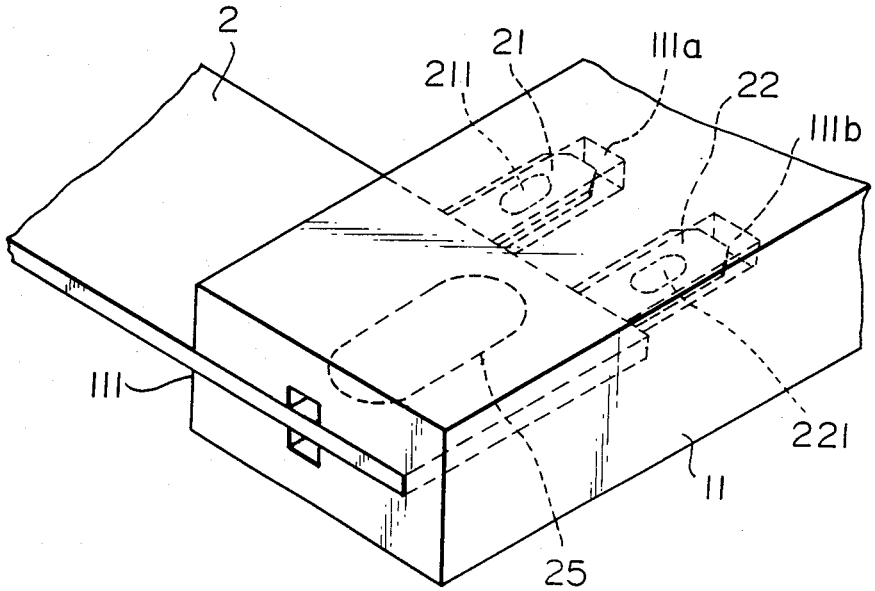
FIG. 3 illustrates an enlarged view of the fixing structure in the device of FIG. 2.
Figure 4:
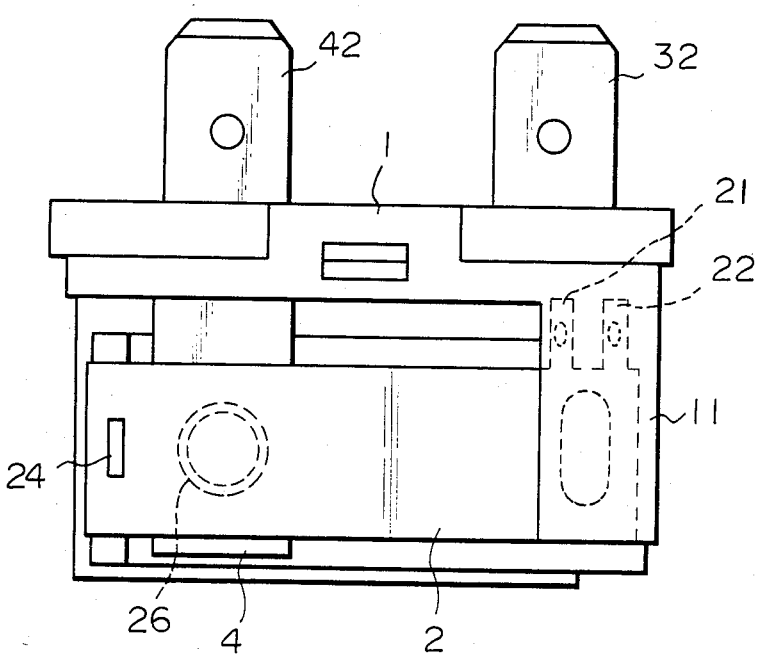
FIG. 4 illustrates the top view of the device of FIG. 2.
Figure 5:
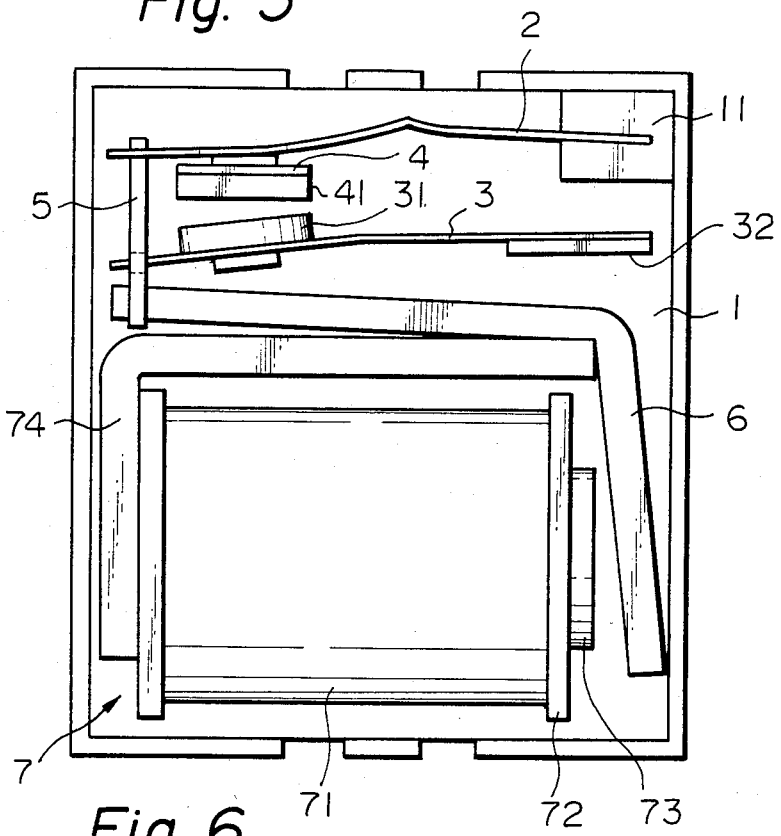
FIG. 5 illustrates the front view of the device of FIG. 2.

The structure of an electromagnetic relay in accordance with an embodiment of the present invention is illustrated in FIGS. 2 through 8. A perspective view of the electromagnetic relay is illustrated in FIG. 2. A perspective view of the important portion of FIG. 2 is illustrated in FIG. 3. The detailed structure of the electromagnetic relay of FIG. 2 is illustrated in FIGS. 4, 5, 6, 7A, 7B and 8.

The electromagnetic relay of FIG. 2 comprises a plastic base block 1, a restoring spring 2, a movable contact spring 3, a fixed contact spring 4, a card 5, and armature 6 and an electromagnet 7. The electromagnet 7 comprises a core 73, a bobbin 72, a coil 71 and a yoke 74. The fixed contact spring 4, the movable contact spring terminal 32 and the two terminal conductors of the coil 71 penetrate through the apertures 12, 13, 14 and 15, respectively. The assembly of the electromagnet 7, the armature 6, the card 5, the fixed contact spring 4, the movable contact spring 3 and the restoring spring 2 is encased in a housing consisting of the base block 1 and a cover (not shown).

When the coil 71 of the electromagnet 7 is energized, the lower portion of the armature 6 is attracted by the core 73 to effect a pivoted motion of the armature 6, and hence the upper portion of the armature 6 pushes the card 5 upwardly. The free end of the movable contact spring 3 is pushed upwardly by the upward motion of the card 5 to cause the fixed contact 41 to come in contact with the movable contact 31. At the same time, the left end of the restoring spring 2 connected to the card 5 is pushed upwardly by the upward motion of the card 5 against the resilient force of the restoring spring 2.

When the coil 71 of the electromagnet 7 is deenergized, the resilient force of the restoring spring 2 causes the card 5 to move downward, and hence the free end of the movable contact spring 3 is pushed downward by the downward motion of the card 5 to cause the movable contact 31 to become disengaged from the fixed contact 41.

The restoring spring 2 is fixed at its right end to a cubic corner protrusion 11 of the base block 1, as illustrated in FIGS. 2, 3, 4 and 5. The fixing structure will be described with reference to FIGS. 6, 7A, 7B and 8.

The cubic corner protrusion 11 of the base block 1 has a horizontal slot 111 in the direction parallel with the surface of the restoring spring 2. At the bottom of the horizontal slot 111, there are provided a plurality of deep holes 111*a*, 111*b*. Between these deep holes 111*a* and 111*b*, a cubic column 111*m* is formed.

Figure 7A:
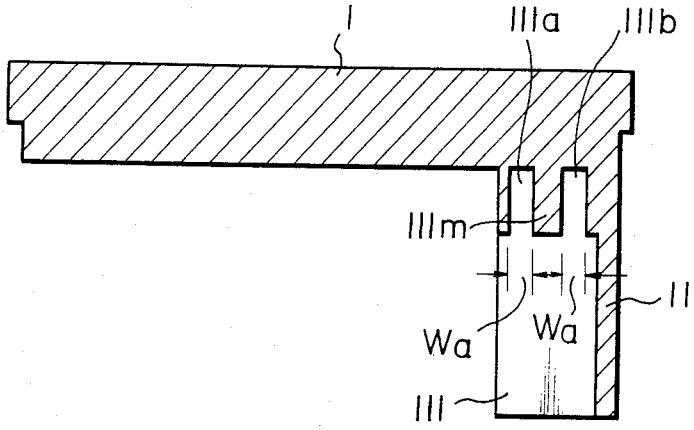
FIGS. 7A and 7B illustrate, respectively, the top views of the structures of the base block and the restoring spring for the fixing structure of FIG. 6.

The restoring spring 2 has, in general, a rectangular shape, except that towards one end thereof a plurality of side projections 21 and 22 is provided. The width $w_a$ of the deep hole 111*a* illustrated in FIG. 7A is a little less than the width $w_b$ of each of the side projections 21, 22. The restoring spring 2 is provided at one end, opposite to that on which the projections are located with a rectangular hole 24 into which the upper end of the card 5 is fitted. At the end portion where the side projections 21, 22 are located, a downward depression 25 of the restoring spring 2 is provided, said depression 25 being formed by a shock-pressing process or the like. The restoring spring 2 may be provided with a circular hole 26, shown in broken lines, through which the upper portion of the fixed contact spring 4 is allowed to penetrate. It is possible to provide depressions 211 and 221 in the side projections 21, 22, said depressions 211 and 221 being formed by a shock-pressing process or the like.

The fixing of the restoring spring 2 to the cubic corner protrusion 11 of the base block 1 is carried out by inserting one end of the restoring spring 2 into the slot 111 of the cubic corner protrusion 11. When the end portion of the restoring spring 2 is inserted into the slot 111 of the cubic corner protrusion 11, the side projections 21 and 22 are inserted into the deep holes 111*a* and 111*b*, respectively. The top of the cubic column 111*m* abuts against the side edge portion 23 of the restoring spring 2 between the side projections 21 and 22. Thus, the end portion of the restoring spring 2, including the side projections 21 and 22, is firmly fixed to the cubic corner protrusion 11 of the base block 1, as illustrated in FIGS. 2, 3 and 6.

Figure 6:
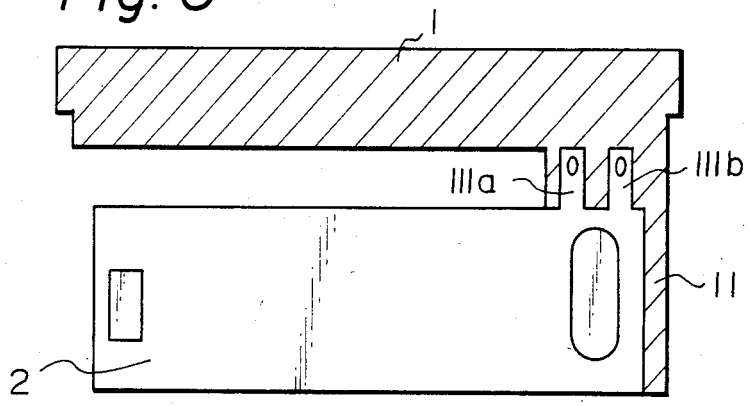
FIG. 6 illustrates the top view of the fixing structure of FIG. 3.

According to the fixing structure illustrated in FIGS. 2, 3 and 6, even when the restoring spring 2 is frequently subjected to a spring action and vibrations, the cubic corner protrusion 111 and the restoring spring 2 remain firmly fixed, so that no loosening of the restoring spring 2 from the cubic corner protrusion 111 takes place.

Although a preferred embodiment has been described hereinbefore with reference to FIGS. 2 through 8, various modifications are possible in the embodiments of the present invention. For example, it is possible to form the side projections 21 and 22 in the direction other than a right angle with respect to the longitudinal direction of the restoring spring 2, although in the embodiment of FIG. 7B the side projections 21 and 22 are formed in the direction of a right angle with respect to the longitudinal direction of the restoring spring 2.

Figure 7B:
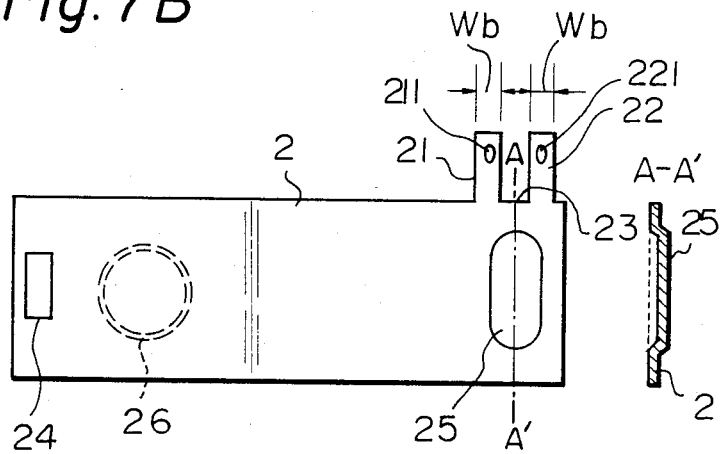
Figure 8:
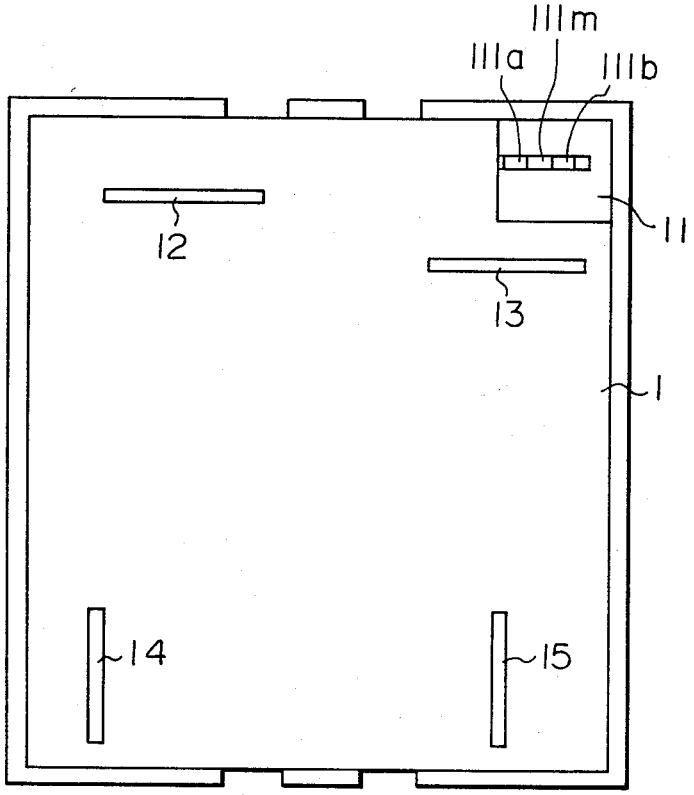
FIG. 8 illustrates the front view of the base block with the assembly of the electromagnet of the electromagnetic relay being removed.

Also, it is possible to form the side projections having a tapered edge in order to make the insertion of the side projection into the deep holes easy. Also, it is possible to increase the number of the side projections, although the restoring spring having two side projections is illustrated in FIG. 7B. Also, although the structure illustrated in FIGS. 2 through 8 relates to the fixing structure of the restoring spring, it is possible to adopt this fixing structure for the fixing of the fixed contact spring or the movable contact spring to the base block.

We claim:

1. An electromagnetic relay comprising a base block, an electromagnet, an armature, a card and a plurality of spring means, and means for fixing at least one of said spring means to said base block comprising:

a solid cubic protrusion formed on a predetermined portion of said base block, said protrusion having formed therein a slot for receiving said one of said spring means and a plurality of deep holes adjoining said slot and extending into said cubic protrusion therefrom, at least one cubic column being formed between said deep holes;

a plurality of side projections formed on a portion of said one of said spring means, said side projections being positioned to fit into said deep holes when said one of said spring means is inserted into said slot with the side edge portion of said one of said spring means abutting against the top of said cubic column;

whereby the end portion of said one of said spring means including said side projections is firmly fixed to said cubic protrusion.

2. An electromagnetic relay as defined in claim 1, wherein said spring means fixed to said cubic protrusion is a restoring spring.

3. An electromagnetic relay as defined in claim 1, wherein said spring means fixed to said cubic protrusion is a fixed contact spring.

4. An electromagnetic relay as defined in claim 1, wherein said spring means fixed to said cubic protrusion is a movable contact spring.

5. An electromagnetic relay as claimed in claim 1, wherein the width of each of said holes is a little less than the width of the corresponding side projection.

6. In an electromagnetic relay comprising a base block, an electromagnet, an armature, a card, and a plurality of spring means, the method of anchoring at least one of said spring means comprising the steps of:

forming a solid cubic protrusion on a predetermined portion of said base block;

forming a slot in said cubic protrusion;

forming a plurality of deep holes in said cubic protrusion adjoining said slot and extending therefrom, constituting consequently at least one cubic column between the formed deep holes;

forming a plurality of side projections on a portion of said one of said spring means, each of said side projections having a width slightly larger than the width of the corresponding deep hole; and inserting said one of said spring means into said slot in such a manner that each said side projection is forceably inserted into one of said deep holes and the side edge portion of said one of said spring means abuts against the top of said cubic column, thereby fixing firmly the end portion of said one of said spring means to said cubic protrusion.

* * * * *